US005427174A

United States Patent [19]

Lomolino, Sr. et al.

[11] Patent Number: 5,427,174

[45] Date of Patent: Jun. 27, 1995

[54] METHOD AND APPARATUS FOR A SELF CONTAINED HEAT EXCHANGER

[75] Inventors: Paul A. Lomolino, Sr., Danville; Paul A. Lomolino, Jr., Tracy; Grace A. Lean, Livermore; Patricia L. Burns, San Jose, all of Calif.

[73] Assignee: Heat Transfer Devices, Inc., Fremont, Calif.

[21] Appl. No.: 56,173

[22] Filed: Apr. 30, 1993

[51] Int. Cl.[6] ..... F28D 15/00

[52] U.S. Cl. ..... 165/1; 165/104.13; 165/104.26; 165/104.33

[58] Field of Search ..... 165/104.13, 104.26, 165/104.33, 1, 2

[56] References Cited

U.S. PATENT DOCUMENTS

| | | | |
|---|---|---|---|
| 3,361,195 | 1/1968 | Meyerhoff et al. . | |
| 4,109,707 | 8/1978 | Wilson et al. . | |
| 4,151,548 | 4/1979 | Klein et al. . | |
| 4,450,472 | 5/1984 | Tuckerman et al. . | |
| 4,461,343 | 7/1984 | Token et al. | 165/104.33 |
| 4,573,067 | 2/1986 | Tuckerman et al. . | |
| 4,975,803 | 12/1990 | Niggemann . | |
| 5,099,908 | 3/1992 | Taraci et al. | 165/104.13 |
| 5,125,451 | 6/1992 | Matthews . | |

FOREIGN PATENT DOCUMENTS

| | | | |
|---|---|---|---|
| 3415554 | 10/1984 | Germany . | |
| 28677 | 2/1991 | Japan | 165/104.13 |

*Primary Examiner*—A. Michael Chambers

[57] ABSTRACT

A self contained heat exchanger useful for reducing the operational temperature of a solid state device utilizing mixtures of two or more coolants within a hermetically sealed chamber or chambers. The present invention includes embodiments that are useful for removing heat from a semiconductor electronic device. The present invention provides a low boiling point coolant that boils at the operational temperatures of the semiconductor devices to agitate a higher boiling point coolant that remains in liquid state. Movement of the higher boiling point coolant is instrumental in uniformly transferring heat from the heat source across metal radiator surfaces due to the excellent surface contact of the heat rich high boiling point liquid. The chamber surface then uniformly radiates the heat into the surroundings. At equilibrium, boiling action of the lower point liquid coolant and condensation on the metal surface create recirculation paths within the present invention that enhances heat transfer. The entire device may rest squarely on top of the semiconductor package and does not require any active mechanical components or external power or maintenance.

22 Claims, 9 Drawing Sheets

METHOD AND APPARATUS FOR A SELF CONTAINED HEAT EXCHANGER

BACKGROUND OF THE INVENTION (1) Field of the Invention

The present invention relates generally to the field of heat exchanging and dissipation devices. Specifically, the present invention relates to the field of heat exchanging and dissipation devices particularly applied to reduce the heat content of a solid state electronic device, such as a semiconductor chip.

(2) Prior Art

Since the advent of solid state electronics and semiconductor devices (i.e., "chips"), there has been a great demand for reducing the size of such devices while increasing their complexity and power consumption. The resultant commercially produced electronic devices suffer from substantial heat production and power consumption due to the large number of transistors packed very densely within the chip package. In may cases, the actual heat radiation of the semiconductor device will damage or destroy the operation of the device if the heat is not rapidly exchanged with the outer environment. Due to the great demand for more powerful computer systems at reduced size and cost, power consumption and heat production of semiconductor devices are increasing in great proportion. For instance, it is not uncommon for semiconductors devices to require from 10 to 50 watts of power for normal operation. Such high power requirements also bring substantial heat consumption and radiation characteristics for such devices. Therefore, there is a demand for efficient heat exchanging devices that are applicable within the size, weight, and power requirements of solid state devices.

In the past there have been a number of prior art devices aimed at dissipating and exchanging the heat produced by solid state semiconductor devices. Once such prior art design is illustrated with reference to FIG. 1(A). This device 18 is a solid piece of uniform metal, such aluminum or steel. The plate 16 is machined such that it contains a number of heat radiating surfaces or finned plates 14. The heat exchanging device 18 also may have a support or base 10 which acts as an alternative heat radiation surface. The heat producing element, i.e., the semiconductor device, is placed onto the heat location 12 (approximately 1 inch by 1 inch in area). Using basic heat transfer characteristics of the metal plate 18, the heat generated at 12 is exchanged between the metal and the environment surrounding the plate over the surface areas of the exposed metal.

The type of heat exchange device as illustrated in FIG. 1(A) is not entirely advantageous because a normal metal plate does not provide a uniform heat distribution throughout the surfaces of the exposed metal due to the thermal resistance of the metal plate. In fact, the heat content or distribution of the plate drops off very quickly for surfaces a short distance from the heat source 12. Without uniform heat distribution across the radiation surfaces, the efficiency of this type of heat exchanger 18 is poor. In addition, to achieve meaningful heat exchanging capabilities, the heat exchanger of this type must be relatively large. According to FIG. 1(A), it can be seen that heat exchanger plate 18 is three to four times larger in dimension then the heat surface 12 which is representative of the relative size of the semiconductor chip. Such large size requirements may be acceptable for desktop computer systems. However, for any computer system having small size requirements such as portable, pen-based and laptop computer systems, such a large heat exchanging plate 18 would simply not be acceptable within their design specifications. What is needed, therefore, is a heat exchanging device that provides uniform heat distribution across the surfaces of the heat exchanging device as well as a device that will accommodate most size requirements of computer systems. The present invention offers such advantageous capabilities.

A second prior art heat exchanger device 20 is illustrated with reference to FIG. 1(B). Such a system 20 includes a heat generating device 22, such as a semiconductor device, and a heat radiator 24 that is in thermal contact with the heat generator 22. A coolant liquid is circulated through predetermined channels 25 of the heat radiator 24 such that a liquid path is formed. The coolant liquid collects heat exchanged from the source 22 as it flows through the heat radiator 24 and is pumped via pump 26 to a cooling unit or condenser 28. The condenser cools the liquid from pump 26, draws the heat from the liquid, and then recirculates the liquid back to the heat radiator 24 via flow channel 30 and the pump 26. It is appreciated that the condenser 28 may be implemented as a chamber having specialized heat radiation surfaces, such as metal plate 18 as discussed above. Further, the condenser may also be coupled thermally with a cool stream of secondary coolant liquid or air current which contributes to the cooling process. Such prior art devices as discussed above used to cool solid state devices are disclosed within U.S. Pat. No. 4,450,472 (dated May 22, 1984) and U.S. Pat. No. 4,573,067 (dated Feb. 25, 1986) both entitled, Method and Means for Improved Heat Removal in Compact Semiconductor Integrated Circuits, by D. B. Tuckerman as well as U.S. Pat. No. 4,109,707 issued on Aug. 29, 1978 to E. A. Wilson, entitled, Fluid Cooling Systems for Electronic Systems.

The above prior art cooling system is not entirely advantageous in the area of semiconductor device cooling for a number of important reasons. Size considerations within a computer system demand that the heat exchanger system be small. The above prior art system does not operate within tight space requirements of a computer system or other electronic device because of the various system components required, such as the pump 26, the circulation channels and the condenser 28. These devices simply require an excessive amount of space and are expensive to miniaturize. Further, within such a system there is a good likelihood of spillage and leakage of the coolant liquid from the closed loop system which can either cause the heat exchanger system 20 to malfunction or cause the computer system to malfunction. In addition, such systems do not allow easy repair and maintenance for the semiconductor device (i.e., the heat generator 22). This is the case because the heat radiator 24 is usually adhesively attached to the semiconductor device to provide a proper thermal couple. In order to remove the device for repair or upgrade, the coolant channels 30 must be separated from the heat radiator. This may cause leakage or spillage of the liquid from the closed loop system and requires reinjection of the coolant after the chip is replaced which is another maintenance expense associated with this prior art system.

Another drawback of such a system 20 is that the pump 26 and other coolant circulation devices are active devices and require power for operation. Such power may not be available in reduced power systems, such as portables and laptops. Also, these prior art systems 20 tend to be complicated in design and operation, requiring a condenser, pump, radiator, liquid channels, etc. The complexity tends to increase the cost of such system and also increases the system failure rate. As a result, what is needed is a heat exchanger that does not require any external pump or external condenser unit or external heat channels that may rupture or leak coolant or that require external power supply to provide coolant circulation. Further, it would be advantageous to provide a heat exchanger system that does not utilize active devices and that allows easy modification and access to the attached semiconductor device. The present invention provides such functionality.

With reference to FIG. 1(C), another prior art design 32 is illustrated. This prior design 32 utilizes a fan 38 to constantly circulate air over the solid state device 36. The air flow 40 will carry away heat radiated from the chip 36. This prior design 32 suffers from the same size requirements of most computer and electronic systems in that the fan typically requires too much room within the system. Further, fans are mechanical and have an inherent failure rate that may not be acceptable for an electronic system. Also, some portable computer systems may not have the space within the chassis to provide a clear air flow path. In addition, the fan 38 is an active device and requires power for operation, such as the pump of the other prior system 20. Therefore, what is needed is a heat exchanger system that does not require external power for operation and is reliable with a low failure rate. The present invention offers such capabilities.

Another prior system, disclosed in U.S. Pat. No. 4,975,803 issued Dec. 4, 1990 to R. E. Niggeman and entitled Cold Plane System for Cooling Electronic Circuit Components, utilizes a fluid filled chamber that is thermally coupled to the semiconductor device. However such a system exchanges heat based on movement of liquid vapor of a low boiling point liquid coolant. It would be advantageous to provide a system that exchanged heat based primarily on movement of a high boiling point liquid coolant that remains in liquid form at the operational temperatures of the target semiconductor device. This is desired because these coolants in liquid form operate more effectively within such a heat exchanger system and act to transfer more heat to the surface of the heat exchanger more efficiently. The present invention provides such an advantageous system.

SUMMARY OF THE INVENTION

Accordingly, it is an object of the present invention to provide a heat exchanger that can be effectively utilized to reduce the operational temperatures of a solid state electronic device. It is further an object of the present invention to provide the above capability without the need for external power supply or any active components. It is yet another object of the present invention to provide a system that is not prone to leakage or spillage of liquid coolant. Another object of the present invention heat exchanger is to provide acceptable heat exchanging capability within tight space requirements of most electronic devices, including laptop, portable and pen-based computer systems. It is an object of the present invention to offer a heat exchanging device having a low failure rate without any moving mechanical parts. It is an object of the present invention to provide a heat exchanging device that utilizes movement of a liquid having a high boiling point, above that of the operational temperature of the electronic device, for heat transfer to a metal surface. It is an object of the present invention to provide the above capabilities in a heat exchanger device that can be optimized for applications that cool a semiconductor device within electronic and computer systems. These and other objects of the present invention not specifically mentioned above will become evident according to the following discussions of the present invention.

Embodiments of the present invention include a self contained closed loop heat exchanger useful for reducing the operational temperature of a solid state device utilizing two or more liquid coolants within a hermetically sealed chamber or chambers. The present invention includes embodiments that are useful for cooling a semiconductor electronic device. The present invention provides a low boiling point coolant that boils within the operational temperatures of the semiconductor device and agitates a higher boiling point coolant that does not reach its boiling point within these temperatures. Movement of the higher boiling point coolant (in liquid state) is instrumental in uniformly transferring heat from the heat source across metal radiator surfaces due to the excellent surface contact of the heat rich high boiling point liquid. The chamber surface then uniformly radiates the heat into the surroundings. At equilibrium, boiling action of the lower point liquid coolant and condensation on the metal surface create recirculation paths within the present invention that allow for heat transfer. The entire device may rest squarely on top of the semiconductor package and does not require any active or mechanical components or external power or maintenance.

More specifically, embodiments of the present invention include, a heat exchanging apparatus for regulating the temperature of a heat producing device within an operational temperature range, the apparatus comprising: coolant mixture means for transferring heat content to inner surfaces of the heat exchanging apparatus, the coolant mixture means comprising a first coolant with a boiling point below the operational temperature range and a second coolant with a boiling point above the operational temperature range; structure means for thermally coupling with the heat producing device and for allowing the first coolant to boil and agitate the second coolant; and condenser means for receiving transferred coolant mixture means ejected from the structure means, the condenser means for uniformly radiating heat transferred thereto by the second coolant, the condenser means coupled to the structure means. Other embodiments of the present invention include the above and further comprising means for reflowing the coolant mixture means from the condenser means to the structure means and wherein the condenser means further comprises plate radiator means for radiating heat with a uniform heat distribution. Embodiments of the present invention also include the above wherein said heat producing device is a semiconductor device, said second coolant is water and said first coolant is a Freon or ammonia.

Embodiments of the present invention include a method of heat dissipation from a heat source, the method comprising the steps of: providing a first chamber for thermally coupling with the heat source and providing a second chamber for condensation; boiling a first coolant in the first chamber, the first coolant having a lower boiling point than an operational temperature range of the heat source; transferring a second coolant from the first chamber to the second chamber, the second coolant having a higher boiling point than the operational temperature range of the heat source; and uniformly radiating heat from the second chamber. Further embodiments of the present invention include the above including the step of reflowing the first coolant and the second coolant from the second chamber to the first chamber. Embodiments of the present invention include the above and wherein the step of transferring a second coolant comprises the step of carrying the second coolant into the second chamber by boiling action and agitation of the first coolant. The present invention include the above wherein the heat source is a semiconductor device, such as a microprocessor and the like.

DETAILED DESCRIPTION OF THE INVENTION

Figure 1A:
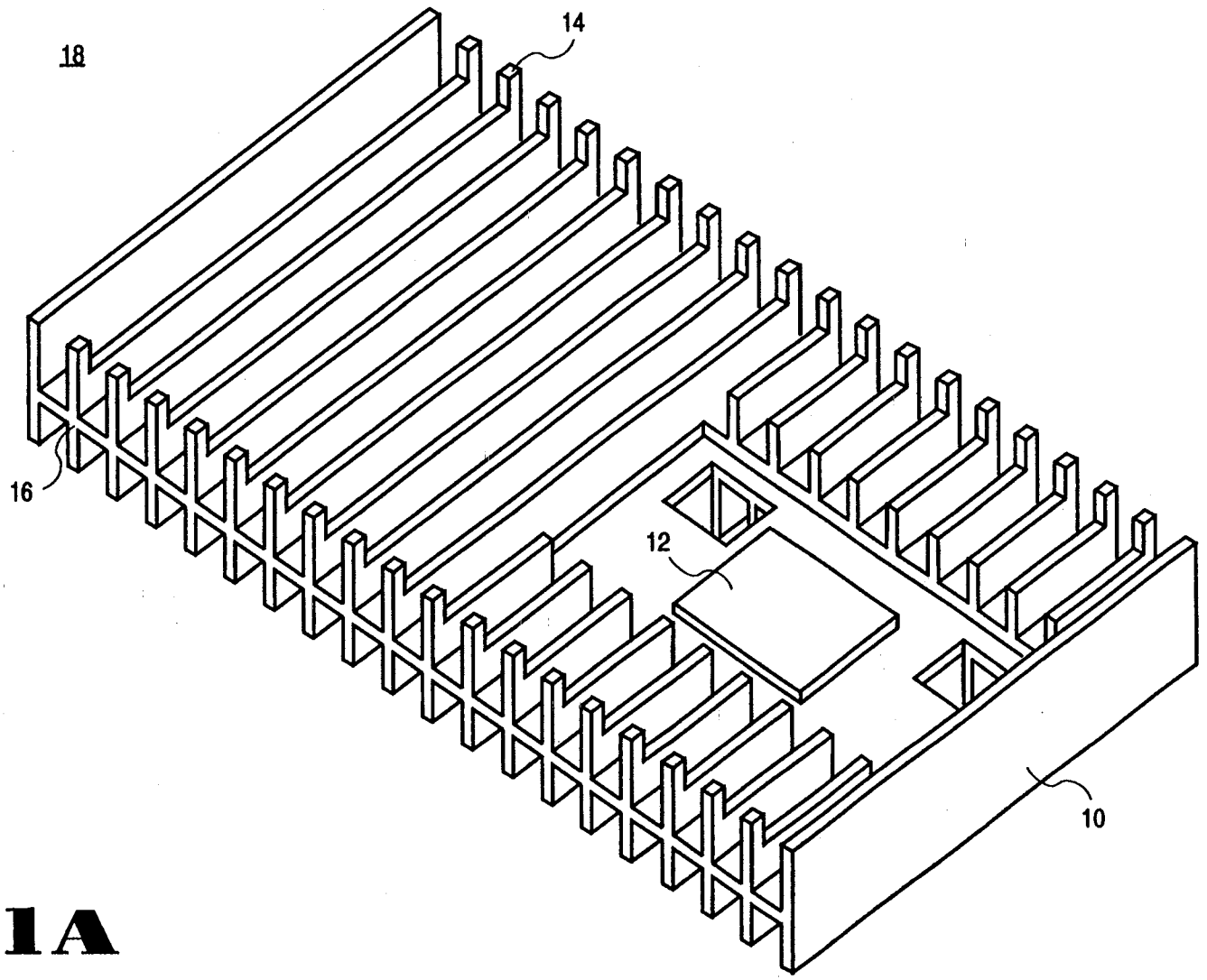
FIG. 1(A) is an illustration of a heat exchanger of the prior art design utilizing radiating metal plates.
Figure 1B:
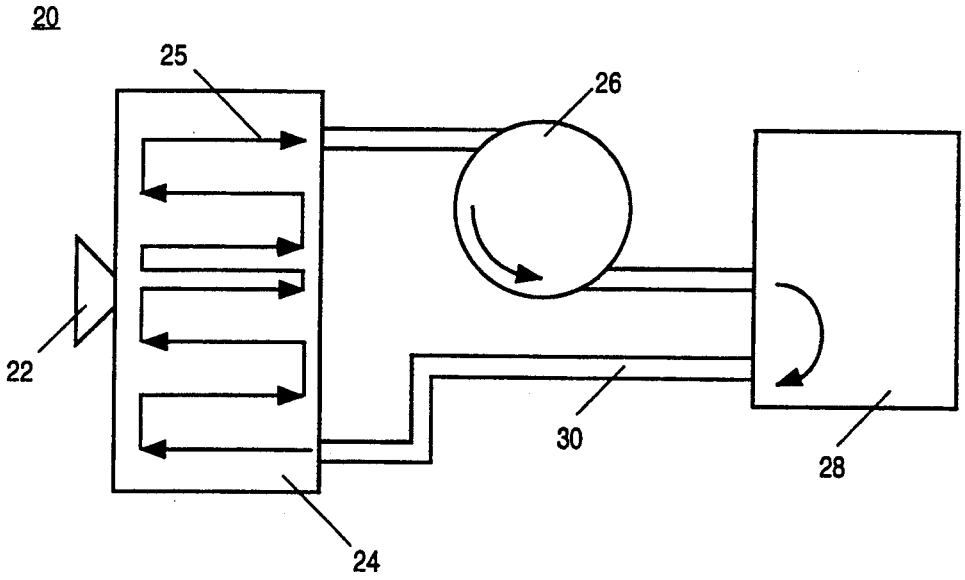
FIG. 1(B) illustrates a prior art design heat exchanger using a closed loop liquid coolant channel and a pumping system that requires external power input.
Figure 1C:
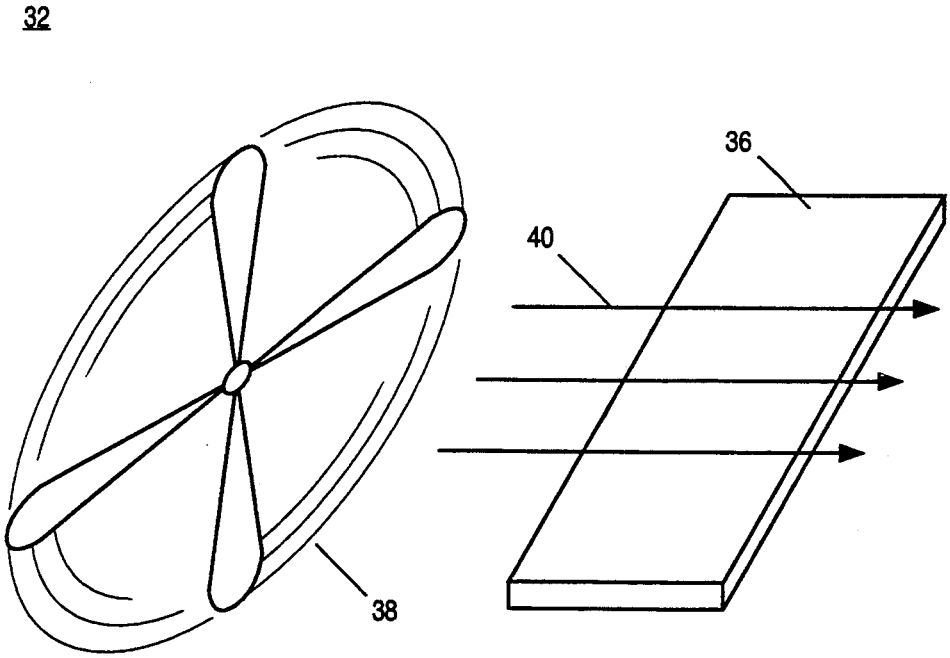
FIG. 1(C) is an illustration of a prior art design heat exchanger that uses a fan cooling system and consumes externally supplied power.

The present invention includes an apparatus and method for heat exchanging utilizing a closed loop, self contained heat exchanging device that requires no external power and that contains no moving mechanical parts. There are several embodiments of the present invention presented herein. Each embodiment of the present invention utilizes a uniform mechanism for heat exchanging and dissipation. The present invention advantageously utilizes mixtures of two or more liquid coolants to achieve uniform heat radiation across the cooling surfaces of the various alternative embodiments of the present invention. The heat exchangers of the present invention include a self contained closed loop structure each having inner surfaces and outer surfaces. The outer surfaces have uniform heat distribution and the inner surfaces act to contain a coolant mixture that is introduced and hermetically sealed into the heat exchanger structure during manufacturing. Action of the unique coolant mixture uniformly distributes heat to the outer, radiating, surfaces of the heat exchanger of the present invention. At least one surface of the heat exchanger of the present invention is thermally coupled to a heat source (i.e., solid state device, or other) to receive an input heat content and an other surface not coupled to the heat source for heat radiation.

In the following detailed description of the present invention numerous specific details are set forth in order to provide a thorough understanding of the present invention. However, it will be obvious to one skilled in the art that the present invention may be practiced without these specific details. In other instances well known methods, procedures, components, and circuits have not been described in detail as not to unnecessarily obscure the present invention.

_ The Coolant Mixture. The coolant mixtures of the present invention comprise at least one liquid coolant that has a boiling point below the operational temperature range of the heat source (i.e., solid state device). The mixtures of the present invention also comprise a second liquid coolant having a boiling point that is above the operational temperature range of the heat source to be temperature regulated ("cooled"). The preferred embodiment of the present invention is configured such that the lower boiling point liquid coolant also has a higher molecular density over the higher boiling point liquid. However this configuration is not a requirement for operation of the present invention, in fact, embodiments of the present invention may utilize a lower boiling point coolant having a lower molecular density as compared to the higher boiling point coolant. It is understood that the coolants within the mixtures of the present invention may or may not be soluble within each other. Coolant mixture wherein the individual coolants are not soluble within each other tend to provide increased efficiency over soluble coolant mixtures.

By utilizing such a coolant mixture, the present invention heat exchangers reach an equilibrium wherein the lower boiling point liquid coolant achieves boiling and acts (in vapor and partial vapor form) as an agitator and movement force to carry, move, and circulate the higher boiling point liquid coolant throughout the inner structures of the closed loop heat exchanger. This is desirable and dramatically increases the ability of the heat exchanger to remove heat from the heat source because, in liquid form, the higher boiling point liquid coolant contains and transfers a larger amount of heat to the surrounding surfaces of the heat exchanger device of the present invention; in liquid form the heat rich high boiling point coolant maintains excellent surface contact with the interior surfaces of the heat exchangers of the present invention. In short, the present invention uniquely utilizes a lower boiling point coolant as an agitator to force a higher boiling point coolant that is rich with heat content to move and circulate throughout the inner surfaces and structures of a closed loop heat exchanging device. This causes the outer surfaces of the heat exchanging device to contain a uniform heat distribution such that the heat can be uniformly (and thus efficiently) radiated to the surrounding surfaces (i.e., air). The uniform heat distribution of the heat exchanging surfaces increases the heat transfer efficiency of the heat exchanger of the present invention.

It is appreciated that embodiments of the present invention utilize water as the high boiling point liquid coolant and utilize a number of various liquids as the low boiling point liquid coolant, such as ammonia, alcohol or Freon 11. The above coolant liquids are illustrated as exemplary coolants only and it is further understood that the present invention will operate utilizing any mixture of liquid coolants having at least (1) a first coolant having a lower boiling point than the desired operational temperature of the heat source such that the first coolant boils and remains in partial vapor and liquid form at equilibrium and (2) a second liquid having a higher boiling point than the desired operational temperature of the heat source such that at equilibrium the second coolant remains in liquid form and does not boil. In some embodiments, the present invention also utilizes a coolant mixture of three or more coolants having variable boiling points, including water, Freon, and ammonia. In such configuration, the low boiling point coolant is actually composed of two low boiling point coolants while the high boiling point coolant remains water. This is advantageous for effective cooling or when two or more operational temperatures are required for the solid state device.

It is appreciated that with respect to all embodiments of the present invention as herein discussed, before the coolant mixture is introduced into the hermetically sealed chamber or chambers, a vacuum is utilized to evacuate any air that is within the chamber or chambers. Once evacuated, the coolant mixture is injected into the heat exchanger and the heat exchanger is then hermetically sealed. Air is removed from the heat exchanger embodiments of the present invention so that it will not react with or denature the coolant mixture and also to allow the heat transferring characteristics of the mixtures to operate more effectively and efficiently.

The following discussions illustrate and describe a preferred embodiment heat exchanger of the present invention and several alternative embodiment heat exchangers. It is appreciated that each heat exchanger embodiment of the present invention utilize heat transfer characteristics of the coolant mixture as described above. It is also understood that while the below discussion illustrates applications of the heat exchangers of the present invention to regulating the temperature of a solid state electronic device, the present invention should not be construed as limited by such application. Rather, the present invention offers a heat exchanger that can be utilized to cool any heat source in a variety of applications apart from cooling a solid state device, such as providing heat exchanging capabilities for a hot plate or engine, etc. However, given that embodiments of the present invention may be configured of a size consistent with current and expected microprocessor packages and that the present invention does not require any external power sources nor does the present invention contain any moving mechanical components, the present invention offers unique heat dissipation capabilities within the environment of solid state devices and particularly to computer systems utilizing such solid state devices. Therefore, the present invention is herein discussed as applied to the area of heat dissipation for a solid state device, such as a microprocessor of a computer system.

Preferred Embodiment of the Present Invention

Figure 2A:
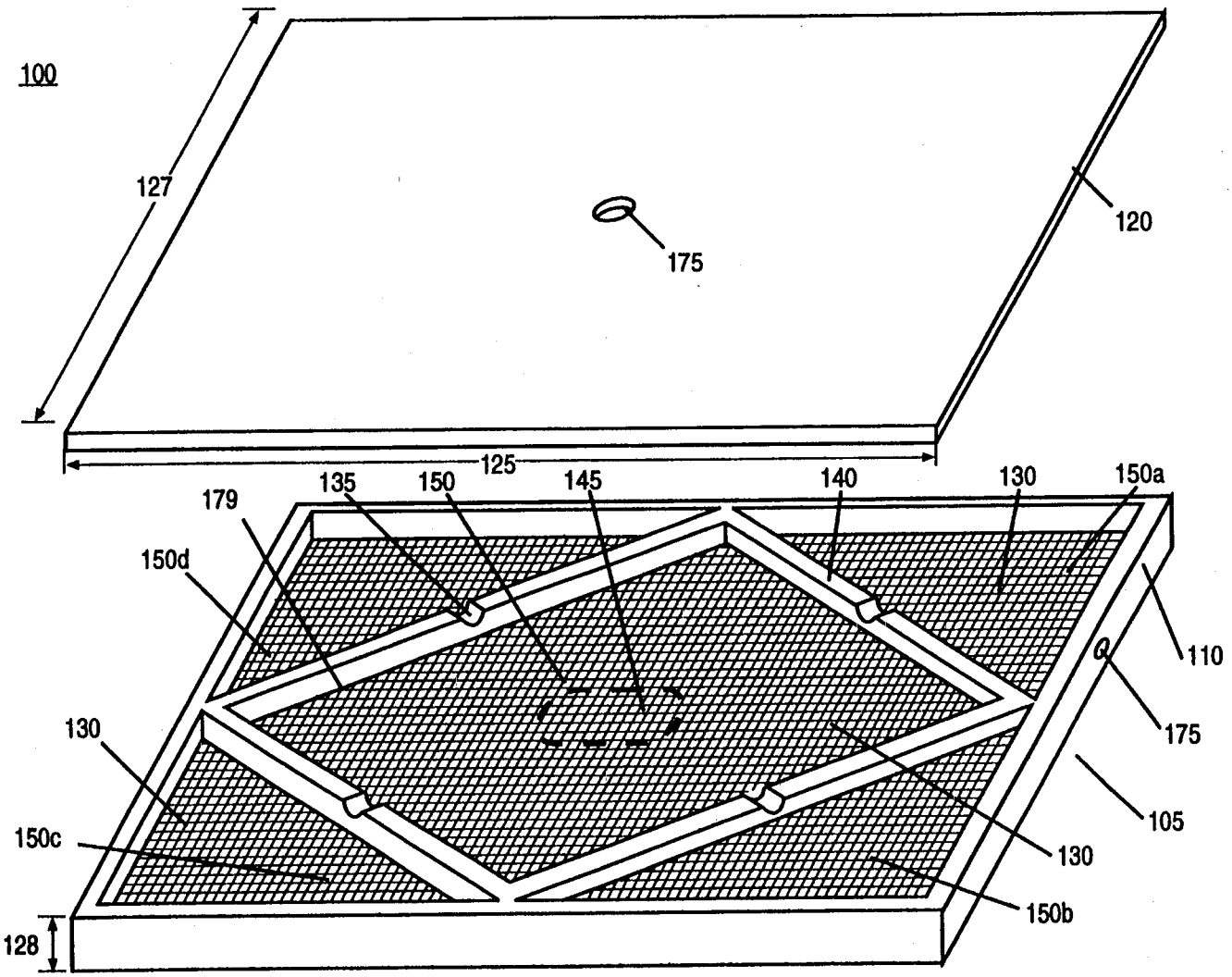
FIG. 2A illustrates the heat exchanger design of the preferred embodiment of the present invention consisting of a hot chamber individual condenser chambers for containing the coolant mixture and an outer exposed surface which may thermally couple with a solid state device.

With reference to FIG. 2A, the preferred embodiment of the present invention is illustrated as heat exchanger 100. The preferred embodiment of the present invention includes a containment structure 110 with associated cover plate or top 120. When assembled, the top 120 cover or radiator plate will be hermetically sealed to the base 110 and a coolant mixture will be injected into the inner chambers via fill hole 175, which will then be hermetically sealed as well. It is understood, as discussed above, that before the coolant mixture is injected into the heat exchanger 100, air within the exchanger is evacuated by a vacuum coupled to the fill hole 175. The precise dimensions of the preferred embodiment are not critical to the operation of the heat exchanger 100 and may be adjusted dependent on the size of the device (i.e., chip surface) to be regulated. However, for exemplary purposes, the heat exchanger 100 when assembled with cover 120 coupled to base 110 is approximately the dimension of a modern state microprocessor package. To this extent, the width dimension 127 is approximately 2 inches and the length dimension is approximately 2 inches. The entire heat exchanger stands approximately $\frac{1}{8}$ to $\frac{1}{2}$ inch in height 128 dimension. It is understood that no particular height, width or length dimension control the effective heat dissipation of heat exchanger 100. However, by way of illustration only specific dimensions are given herein. The base 110 and top 120 are composed of metal, for example, aluminum. However, any metal with an effectively low heat resistance may be advantageously utilized within the scope of the present invention.

The heat exchanger 100 of FIG. 2A is composed of a base 110 that is thermally coupled to the outer surface of the packaging of a solid state device. The underside (not shown in FIG. 2A but indicated by arrow 105) of the base 110 is coupled, via adhesive, to the solid state device surface so that it may provide a thermal couple to remove and transfer heat from the solid state chip. As shown, the base is composed of five separate chambers, a center chamber 150 which is called the hot chamber, and four cool chambers 150(*a*)–150(*d*) located on the corners of the base 110. The exact number of chambers is not critical to the design of the preferred embodiment of the present invention. What is important, however, is that there be a hot chamber and at least one other cool chamber within the heat exchanger 100. The hot chamber 150 has an area 145 that is situated directly above the heat producing area of the chip, which is the integrated circuit die for semiconductors, but could be any location within a solid state device that produces heat content. This is the heat receiving area or "hot spot" 145 and receives the largest amount of heat energy from the device. The low boiling coolant of the injected coolant mixture will boil most vigorously within the hot chamber 150. It is important that the heat received from hot spot 145 be quickly and uniformly distributed, according to the invention, against all inner surfaces of the heat exchanger 100 so that the outer surfaces (specifically the outer surface of cover 120) may uniformly radiate heat. It is appreciated that the volume of the hot chamber 150 is equal to or greater than the sum of the volumes of each of the other cold chambers 150(*a*) to 150(*d*).

Each of the five chambers of heat exchanger 100 are separated by four individual thin walls that form one wall structure 140 that is the same height as the outer walls of the base 110. At this height, the top surface of the wall structure 140 is flush with and seals to the lower surface of the cover 120 when the heat exchanger 100 is assembled. Each of the four walls contains a small notch (approximately 1 millimeter square) that allows flow of coolant between the cold chambers 150(*a*)–150(*d*) and the hot chamber 150. For example, notch 135 is shown between camber 150(*d*) and 150. There are separate notches to allow coolant flow between chambers 150(*a*) and 150, chambers 150(*c*) and 150 and chambers 150(*b*) and 150. It is understood that the width of the wall structure is approximately 1–5 millimeters.

Underneath the wall structure 140, and underneath each of the five chambers, is located a very thin and finely spaced metal mesh plane. This mesh plane is less than 0.5 millimeters in height and allows for coolant condensation and movement within and between (i.e., beneath) the five chambers. Coolant may traverse adjacent chambers via the mesh plane 130 underneath the wall structure 140. The mesh structure 130 traverses the entire bottom area of the base 110 and therefore allows movement and condensation of coolant throughout this surface. As shown in FIG. 2A, the coolant may flow under edge 179 of the wall structure 140 via the mesh plane between cold chamber 150(*d*) and chamber 150. The same is true for the other cold chambers.

Either before or after the top 120 plate is assembled on top of the base 110, a coolant mixture is injected into the chambers of the present invention heat exchanger 100. The coolant of the preferred embodiment is a mixture of 50% water and 50% ammonia. However, mixtures of Freon 11 and water and mixtures of alcohol and water may be used. The actual mixture percentages may also be varied within the scope of the present invention; such as 60% or 80% percent mixture of the high boiling point liquid or vice-versa. Ammonia and Freon 11 are selected as low boiling point coolants because these liquids will boil at the operational temperature of most of the solid state devices, however water will remain in liquid form. The volume of mixture that is introduced to the heat exchanger is that volume that exceeds, at equilibrium, the volumetric sum of the volumes of the cold chambers. This is done so that at equilibrium, the coolant mixture may not totally accumulate within the cold chambers 150(*a*)–150(*d*), but will be directed, under equilibrium forces, to recirculate through the hot chamber 150. Once injected via 175, the inlet 175 is hermetically sealed. Therefore, the entire heat exchanger is self contained once assembled. Circulation of coolant mixture is therefore accomplished in a closed loop within the structure of the heat exchanger 100 when assembled.

In operation, the heat exchanger 100 is able to create a uniform distribution of heat across the top surface of plate 120 as well as the remainder of the outer surfaces of the heat exchanger 100. This uniform distribution of heat is the product of circulating coolant that channels the heat from 145 to the remainder of the inner surfaces of the assembled structure (110 and 120). The circulation of high boiling point coolant is made effective by a combination of water, a high boiling point coolant, and a low boiling point coolant, such as ammonia or Freon 11. The low boiling point coolant provides the agitation of the water, which as a liquid, effectively carries and moves a great deal of heat and may transfer that heat, very effectively as a liquid, to the inner (and therefore outer) surfaces of the heat exchanger 100.

Specifically, the preferred embodiment of the present invention is positioned on top of a semiconductor device that is to be temperature regulated, such as a microprocessor device within a computer system. The top surface of the semiconductor package or "carrier" is approximately of the same width 127 and length 125 dimension as the heat exchanger 100. The semiconductor die will generate heat at 145 which will cause the low boiling point coolant to boil and agitate. The boiling bubbles, vapor, and resultant agitation will force the high boiling point coolant (in liquid form) to move from the hot chamber 150 to any of the four cold chambers through inlets 135. Each cold chamber acts as a condenser to condense the low boiling point coolant and to transfer heat from the coolant mixture to the outer surface of plate 120. Also, the liquid water is forced from the hot chamber 150 to one of the cold chambers 150(*a*)–150(*d*) through an associated notch hole 135 of the wall structure 140. Once within the condenser chambers, the water, in liquid form, effectively transfers its heat to the surrounding surfaces, including the top plate 120. This heat is then dissipated or radiated to the surrounding environment.

The mesh plane 130 has two functions. It acts as a condenser device for the low boiling point liquid and also acts as a flow channel for the coolant liquid. Within the cold chambers, the low boiling point liquid will condense onto the mesh plane 130 due to the fine mesh design. This action of condensation onto a mesh is a well known principle. The mesh also acts to direct the coolant from the cold chambers 150(*a*)–150(*d*) to the hot chamber 150 through capillary action. As the low boiling point coolant is boiled and carried away from area 145 along with the water, a coolant void is established within area 145. Since the coolant mixture collects within the cold chambers and is being vacated from the hot chamber 150, capillary actions within the mesh plane 130 cause coolant mixture to flow from the cold chambers to the hot chamber 150 in channels that exist underneath the wall structure 140 under edge 179.

It is appreciated that a recirculation of the coolant mixture is therefore established at equilibrium within the present invention. Hot coolant mixture enters the cold chambers via the notch 135 and then exits the cold chamber to the hot chamber 150 via the mesh channels of mesh 130 under capillary forces. At equilibrium, this circulation acts to effectively transfer heat from the hot spot 145 to the condenser chambers and to each of the inner surfaces of the heat exchanger 100 and especially to the plate 120 such that the plate 120 has a uniform heat distribution for effective heat dissipation. In so doing, the outer surfaces of the heat exchanger 100 maintain a uniform heat distribution of relatively high intensity and therefore effectively and efficiently radiate energy to the surrounding environment to regulate and dissipate the heat content of the semiconductor device.

For illustrative purposes only, Table I below presents temperature results for one configuration of the preferred embodiment heat exchanger of FIG. 2A using only a single layer design with water and ammonia as the coolant mixture and a relatively small dimension exchanger. It is appreciated that multiple layer designs of larger dimension will provide significantly larger heat dissipation capability as compared to the results of Table I. As shown, the temperature of the solid state device is presented with the heat exchanger and without the heat exchanger present. The power input column represents the power in watts drawn (consumed) by the solid state device, i.e., microprocessor power consumption amount.

TABLE I

| Power Input (Watts) | Temperature with Heat Exch (Celsius) | Temperature w/o Heat Exch (Celsius) |
|---|---|---|
| 2 | 27.5 | 38.5 |
| 4 | 32 | 54 |
| 6 | 36 | 69 |
| 8 | 40 | 84 |
| 10 | 44.5 | 95 |
| 12 | 49 | over 100 |
| 14 | 53 | over 100 |
| 16 | 57 | over 100 |

Figure 2B:
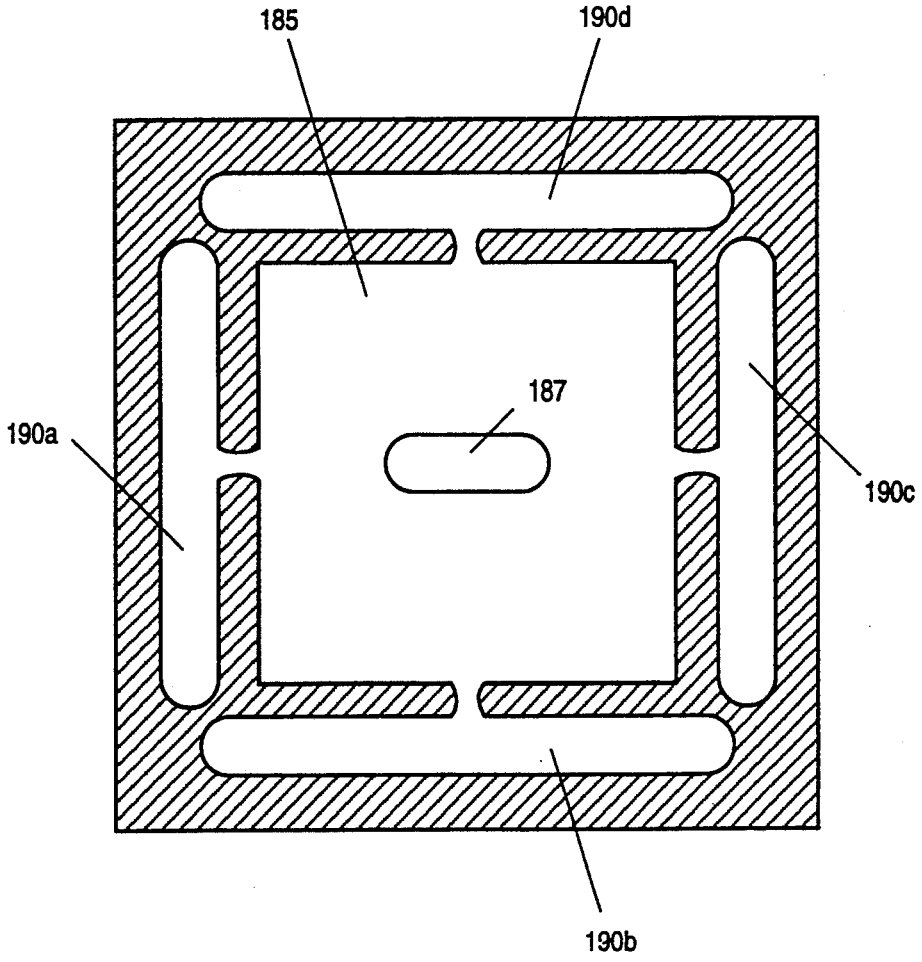
FIG. 2B illustrates the heat exchanger design of the preferred embodiment of the present invention adopting an alternative shape configuration of the hot chamber and the condenser chambers.

The precise size and shape of the chambers of the present invention are not critical. However, it is critical, as discussed above, that there be at least one hot chamber for receiving the hot spot 145 and at least one peripheral condenser chamber. Some implementations of the heat exchanger of FIG. 2A utilize a central hot chamber that is rectangular in shape but having walls in parallel with the outside surface geometry of base 110. This configuration of the preferred embodiment is illustrated in FIG. 2B. FIG. 2B illustrates a top view of the heat exchanger of this alternative configuration with the top cover removed to expose the inner chamber configuration. In this embodiment, the condenser chambers 190(*a*)–190(*d*) are oval shaped and run along (i.e., parallel with) each of the four walls of the rectangular hot chamber 185. The hot spot 187 is located within the central chamber 187. Inlets allow the coolant mixture to circulate between chambers. The above is discussed only to show a possible variation of the heat exchanger 100 of FIG. 2A utilizing differently shaped and configured hot and cold chambers. A mesh plane is also present for recirculation of condensed coolant mixture to the hot chamber 185.

Since the heat exchanger 100 of the present invention, as shown in FIG. 2A, is a closed loop system, the coolant does not require exchanging or addition. There are no electrical pumps, fan or mechanisms of any kind that require external power supply. The system of the present invention 100 is self contained in that no other external or peripheral devices are required, such as radiators or liquid channels, etc. Additionally, the heat exchanger is small in size. The preferred embodiment may be implemented with a height of $\frac{1}{8}$ to $\frac{1}{4}$ inch and width and length dimension analogous to the regulated device. Using such a system, the temperature of a semiconductor die may reside around 150 degrees Fahrenheit for a typical application while the top surface 120 is at 100 degrees. Without the heat exchanger 100 the temperature of the semiconductor die would well exceed 190 degrees Fahrenheit in some applications.

It is understood that an embodiment of the present invention as shown in FIG. 2A may be improved using a plate radiator having finned plates as shown in FIG. 1(A). If there is enough room within the overall electronic system to allow, the plate radiator may be attached (thermally coupled) with the top plate 120 of the preferred embodiment to facilitate heat dissipation. The plate 120 contains a uniform heat distribution as discussed above. In this environment, the plate radiator is used to help dissipate the heat contained in the top plate 120. Although not required by the present invention for efficient performance, the plate radiator may be added to the overall design of FIG. 2A if space and other considerations allow.

Additionally, several heat exchangers 100 of the present invention may be stacked on top of each other in layered fashion to increase heat dissipation and performance. In such fashion, a first heat exchanger is thermally coupled to a surface of the solid state device package and a second exchanger is coupled to the first exchanger 100. The first exchanger 100 acts as a heat source for the second heat exchanger. In this arraignment, the first heat exchanger has a low boiling point coolant that boils at a higher temperature as compared to the low boiling point coolant of the second heat exchanger. This is the case since the first heat exchanger operates at a higher temperature equilibrium as compared to the second heat exchanger, and so on for arraignments having more than three layers.

First Alternative Embodiment

Figure 3:
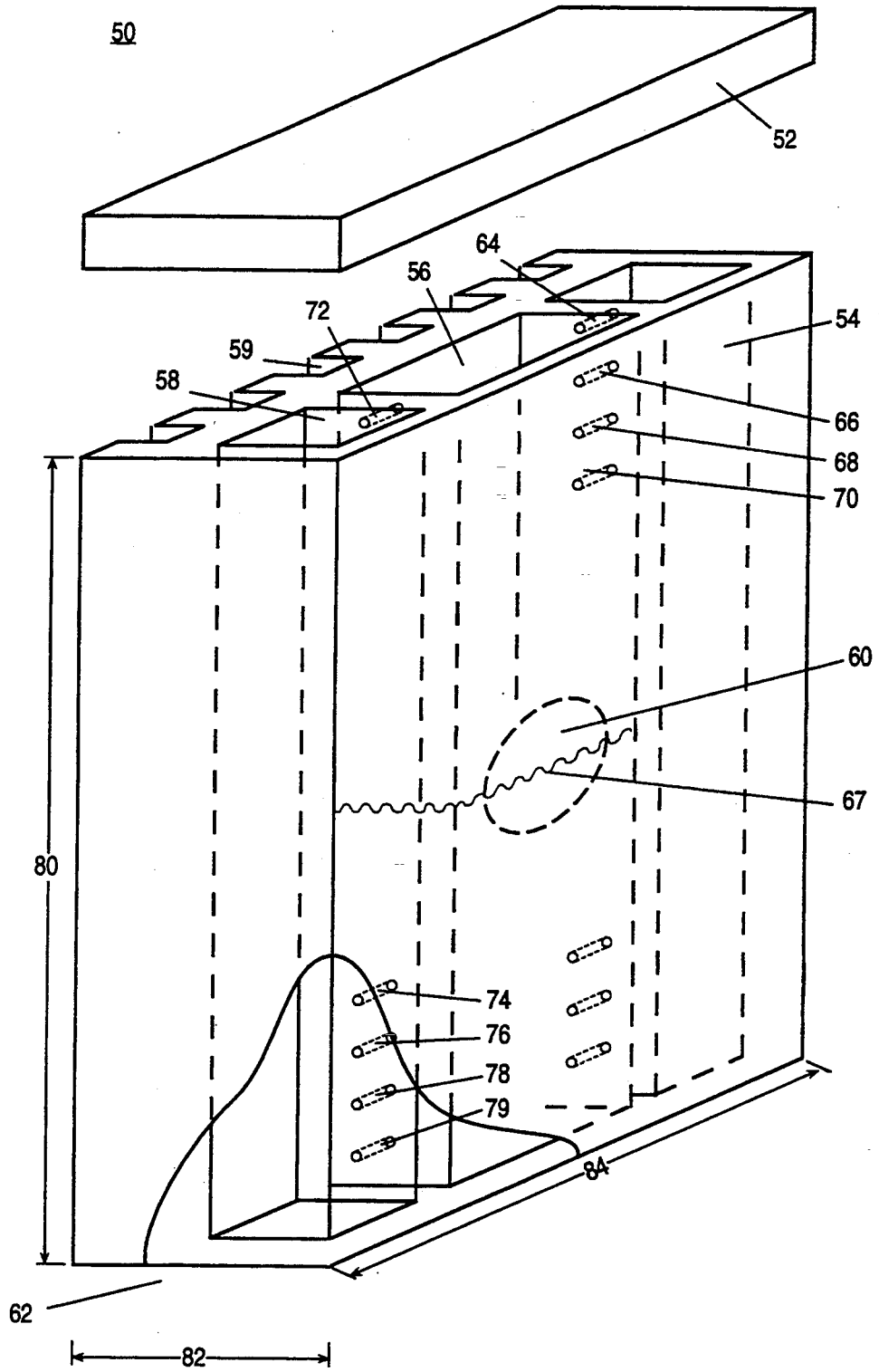
FIG. 3 illustrates a heat exchanger of a first alternative embodiment of the present invention having individual inner chambers for containing coolant mixture.

With reference to FIG. 3, a first alternative embodiment of the present invention is illustrated. This alternative embodiment heat exchanger 50 is roughly of the same or similar dimension as the heat exchanger 100. This heat exchanger has three inner tubes or circular chambers 58, 56, and 54 that run the length 80 of the base 62 of the device. The central chamber 56 is the hot chamber and the two outer tubes 58 and 54 are the cold or condenser tubes. The length may be any size and may be particularly designed to accommodate a specific semiconductor device, such as a microprocessor. As exemplary dimensions, the height 80 of the first alternative embodiment is 1.5 to 2.0 inches, the width 82 is 0.5 to 0.75 inches and the length 84 is 1.5 to 2.0 inches; however, these may be varied within the scope of the present invention. Along the outer surface of the heat exchanger 50 are located radiator plates 59 which are composed of a number of groves (six are shown in FIG. 3) cut into the surface of the metal to promote heat dissipation. A top plate 52 is also shown which will adhesively couple with the bottom base 62 to hermetically seal the inner tubes 58, 56, and 54. It is understood, that like the preferred embodiment, the first alternative embodiment may be composed of a metal characterized with low heat resistance, such as aluminum. A coolant mixture as described above is injected into the inner chambers before sealing.

The heat exchanger 50 also contains many small flow restricter holes cut between the walls between the two inner tubes and the central tube. These holes, or capillaries, allow coolant flow between the larger central chamber 56 and the two smaller outer chambers 54 and 58. These capillaries are also called flow restricters. FIG. 3 illustrates a number of these restricter capillaries 64, 66, 68 and 70 between the central tube and the outer tube 54. It is understood that while only a few capillaries are shown near the top, according to the present invention there are many capillaries that exist throughout the entire height of the tubes 56 and 54 from top to bottom; the same is true for tube 58. The bottom front portion of the heat exchanger 50 is shown exposed to more clearly illustrate components of the present invention. Flow resistor capillaries 74, 76, 78, and 79 are shown, as well as top capillary 72, allowing coolant flow between the central tube 56 and tube 58. A coolant mixture is injected into the central tube 56 of the present invention to fluid level 67. It is appreciated that the volume of coolant mixture introduced into the central tube 56 is in excess of the sum of the volumes of the outer condenser tubes 54 and 58. This is done so that at equilibrium there must continually be coolant mixture within the central or hot chamber 56. The hot spot of the first alternative embodiment is located as region 60 on the facing side (surface) of the heat exchanger 50. This is the side that will adhesively couple with the solid state device to receive input heat content.

According to the orientation of FIG. 3, this alternative embodiment of the present invention may operate in an upright position oriented with cover 52 facing upward. In this configuration, gravity will act to pull the coolant mixture toward the bottom capillaries (i.e., 74, 76, 78, 79) for recirculation upon condensation. In this orientation, the solid state device, i.e., microprocessor, will be mounted on a card that is vertically aligned. While mounted in this orientation in FIG. 3, the heat exchanger 50 may also operate in any orientation with respect to gravity; however when oriented as shown in FIG. 3 the first alternative embodiment operates most effectively.

In operation, the hot spot 60 acts to boil and agitate the coolant mixture so that the low boiling point coolant (i.e., Freon 11, or ammonia) will boil and bubble. The boiling vapors and bubbles of the low boiling point coolant will capture hot liquid water (the high boiling point coolant) and force the hot liquid water upward in the center chamber 56. The hot liquid water and vapor from the low boiling point coolant will travel through the upper capillaries (such as 72, 64, 66, 68 and 70 which are above the coolant level) into the outer condenser chambers 58 and 54 where the vapor will condense and the hot liquid water and the vapor will transfer heat to the surfaces of the condenser tubes 54, 58 and thus to the outer surfaces including surface 59 with the radiation plates. When condensed, the water and low boiling point coolant will circulate back into the center chamber via the lower capillaries (such as 74, 76, 78, and 79 which are substantially below the coolant level) under capillary action. Because the center chamber 56 is vacating coolant mixture, capillary forces act to draw in coolant from the condenser tubes 58 and 54 into the hot chamber 56. Therefore, at equilibrium the coolant mixture will be distributed within the three inner tubes 56, 58, and 54 of the heat exchanger 50 of the present invention. As herein discussed this embodiment of the present invention makes use of the boiling force of the lower boiling point coolant to provide circulation forces and energy to move the hot liquid water throughout the inner chambers of the heat exchanger 50 so that the water may transfer heat to surfaces of the chambers in order to provide uniform heat distribution across the outer surfaces of the heat exchanger.

The heat exchanger design of FIG. 3 may be improved by adding a mesh (not shown) on the inner surfaces of the tubes 54 and 58. This will act to slow down the flow of the vapor and liquid water within these condenser tubes near the mesh due to the resistance cause by the mesh. The mesh will also promote condensation of the vapor of the low boiling point coolant. These two functions will act to promote heat transfer from the vapor and liquid water to the metal surfaces of the condenser tubes and therefore will promote more heat transfer to the outer surfaces of the heat exchanger 50. In so doing the mesh will contribute to the heat exchanger's ability to create uniform heat distribution over its outer surfaces for heat dissipation.

It is understood that the heat exchanger 50 of the first alternative embodiment of the present invention may operate at any orientation. In the instance where all capillaries appear to be at or below the coolant level (i.e., in a horizontal orientation), boiling forces of the low boiling point liquid will cause vapor and hot liquid water to exit into the condenser tubes 54 and 58. Since there is more volume of coolant than volume of condenser tubes, at some point at equilibrium, the condensers 54, 58 will channel coolant mixture back to tube 56 under capillary and equilibrium forces. Those capillaries that are of lower relative temperature will return the coolant mixture to the central chamber 56. It is understood, however, that when vertically oriented as shown in FIG. 3 the heat exchanger 50 is most efficient. Also, although reference is made to "liquid water" is it appreciated any coolant may be substituted for water as long as the selected coolant remains in liquid form over the operational temperature of the solid state device, i.e., below 212 degrees Fahrenheit.

Second Alternative Embodiment

Figure 4:
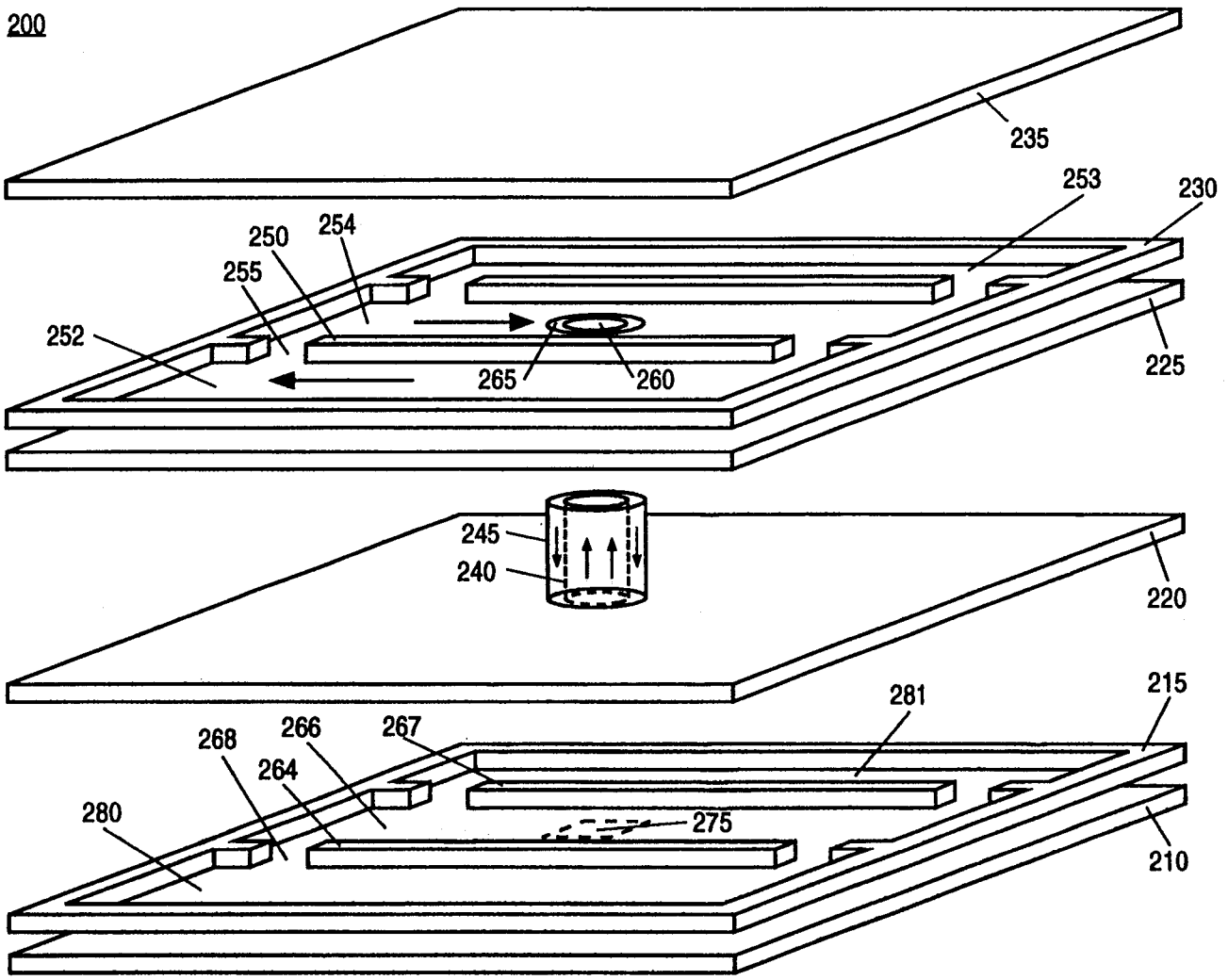
FIG. 4 is an illustration of a heat exchanger of a second alternative embodiment of the present invention utilizing central column for transferring hot and cold coolant mixture between alternate plate radiators via the inner surface of the tube which may be exposed.

With reference to FIG. 4, a second alternative embodiment of the present invention heat exchanger is illustrated. This heat exchanger 200 utilizes a transfer tube or column 245 that separates two separate stages of the heat exchanger 200. Hot vapor from the low boiling point ("LBP") coolant and hot liquid from the high boiling point ("HBP") coolant are forced upward from the lower stage to the upper stage condenser 230 and will ultimately recirculate back to the lower stage 215 after transferring heat to the outer surfaces of the heat exchanger 200. It is appreciated that the dimensions of the second alternative embodiment of the present invention are not critical and may be configured to a particular application to regulate a solid state device. Specifically, the heat exchanger 200 of the present invention is approximately 1.0 to 2.0 inches square and $\frac{1}{8}$ to $\frac{1}{4}$ inch high. However, since this heat exchanger can be implemented in stacked layered configuration the height is adjustable as required to maintain an operational temperature. Height 19 also adjustable based on the length of the central tube 245 selected. It is understood that the volume of coolant injected into the heat exchanger 200 is that volume in excess of the sum of the volume of the chambers of the second stage 230 such that, at equilibrium, coolant vapor is not allowed to collect and remain in the second stage 230, but will be forced back down to the first stage 215. This will be discussed further below.

The heat exchanger 200 of the design of FIG. 4 is composed of six basic layers. The first or bottom layer is bottom cover 210 and this is the surface that is adhesively coupled to the heat producing surface of the solid state device. A second layer 215 contains several machined chambers 281, 266 and 280. The center chamber 266 is the hot chamber and contains the hot spot 275 which is directly above the die of the solid state device. There are also two condenser chambers 281 and 280 on either side of the hot chamber 266. The chambers are separated by two wails 264 and 267 which separate condenser chamber 280 from hot chamber 266 and condenser chamber 281 from hot chamber 266, respectively. Separations within the wall 264, such as notch 268 allow coolant mixture flow between the three lower chambers of the heat exchanger 200. These three chambers of the heat exchanger (281, 266, 280) operate in substantially the same manner as the chambers of the preferred embodiment of the present invention heat exchanger 100. To this extent, the cover plate 220 and 225 are used in heat radiators to help dissipate and uniformly distribute the heat within the heat exchanger 200.

In operation, heat from the hot spot 275 forces hot LBP coolant vapor and hot HBP coolant liquid: (1) into the condenser chambers 281 and 280; and (2) upward into the column 245. Variable height column 245 is mounted on a plate housing 220 which is coupled to plate 215 during assembly in order to complete the lower three chambers. The center of column 245 is positioned such that it is directly above the hot spot 275. When assembled, the column's lower intake is situated just above the hot spot 275. Interior cover plate 225 is coupled to plate 220 and plate 225 contains an aperture in the center to allow through passage of the column 245. Upper stage 230 receives the top of the column 245 through aperture 265 as shown in FIG. 4. The upper stage 230 also contains three chambers: a center chamber 254 and two peripheral chambers 252 and 253. Analogous to the first stage 215, the three chambers of the upper stage 230 are separated by interior walls (such as 250) having small notches cut into them (such as 255) to allow free flow of the coolant mixture during equilibrium. An upper cover plate 235 couples to the second stage 230 to complete the upper three chambers 253, 254, 252. The upper cover plate 235 is maintained at a uniform heat distribution at equilibrium of the heat exchanger 200 due to the movement of the coolant as will be explained below. This surface 235 radiates heat into the surrounding environment. When assembled it is understood that the column 245 is exposed between plates 220 and 225.

As discussed above, hot LBP coolant vapor (ammonia or Freon 11) and hot HBP liquid coolant (water) is forced upward through the central column 245 and through opening 260 and into the central chamber 254 of the upper stage 230. This upper stage operates substantially as a condenser stage. The hot coolant mixture once entering the center chamber 254 will flow through the notches (such as 255) into the peripheral chambers 253 and 252. The hot coolant mixture will condense within the peripheral chambers 253 and 252 as well as within the central chamber 254 and transfer heat to the plate 235. After condensation, under forces that are in play during equilibrium, some of the condensed mixture will collect within the central chamber 254 and flow down the central column 245 along the inner surface 240 of the column. Therefore, the column 245 provides two important functions. First, it allows hot LBP coolant vapor and hot HBP coolant liquid to be forced upward from the first stage 215 into the second stage 230 via the center of the column. And second, the column 245 allows the condensed mixture to flow along the inner surface 240 of the column back to the first stage 215 from the second stage 230. Coolant flowing back to the first stage 215 is heated once more at 275 and circulated back to the second stage 230 or to the condenser chambers 281 and 280 the above continues at equilibrium.

When assembled, the cover plate 235 is coupled to the second stage 230 to complete the upper chambers of the heat exchanger 200. The second stage 230 is coupled to the plate 225 which is coupled to plate 220 to allow upward passage of column 245. Plate 220 is coupled to the top of the first stage 215 to complete the lower three chambers. Column 245 coupled plate 220 to plate 225. Lastly, plate 210 is coupled to the first stage 215. It is appreciated that many successive stages may be layered together, one on top of the next with connecting columns in order to form a larger heat exchanger capable of larger heat transferring performance and capacity. As each stage is added, the resultant heat dissipation performance and capacity of the heat exchanger of the present invention increases.

According to the operation of heat exchanger 200, when equilibrium is reached, hot LBP vapor and hot HBP liquid are forced into condenser chambers 281 and 280 of the first stage 235 as well as into the second stage 230. At these points, heat is radiated to the outer surfaces of the heat exchanger 200, including surface 235 to maintain a uniform heat dissipation across the outer surfaces of the heat exchanger 200. Condensed and cooled coolant mixture then flows back down column 245 and from the condenser chambers 281 and 280 to the hot spot 275 for recirculation.

The heat exchanger 200 of FIG. 4, when assembled, allows the outer surface of the central column 245 to be exposed to the environment because the aperture of the lower plate 225 will hermetically seal the column to the second stage. Further, the plate 220 will hermetically seal the lower end of the column to the first stage 215. In so doing, plates 220 and 225 become effective radiators of heat, just as plate 235. Therefore, the complexity of the heat exchanger 200 offers more heat dissipation surfaces over some other designs of the present invention. Because the column 245 is hermetically sealed between the stages, the column may be made of variable height. In the present invention the column may be configured from $\frac{1}{4}$ inch to 2.0 or 3.0 or more inches if desired. Such height extensions are advantageous if the solid state device requires monitoring with certain probe equipment and space allows for the condenser stage 230 to be located someplace above the lower stage 235 away from the probes and probing areas.

It is appreciated that a mesh plane may be placed underneath the separation walls 264 and 267 of the first stage 215 throughout the entire lower surface of stage 215 (analogous to the preferred embodiment heat exchanger 100) to facilitate condensation and recirculation of coolant to the hot spot 275 via capillary action. Mesh plane may also be placed underneath the walls 250 of the second stage 230 to likewise facilitate condensation of the coolant and direction of the coolant (via capillary action) back down the central column 245. Importantly, the inner surface 240 of the central column 245 may be lined with a mesh plane to facilitate movement of the condensed coolant down the column 245 and to provide a physical separation between the condensed coolant returning to the first stage 215 and the hot coolant being ejected from the first stage.

It is understood that a variation of this embodiment of the present invention as shown in FIG. 4 may be implemented using two or more column structures instead of the single column as shown. In this embodiment variation, hot coolant mixture would be shot up through the central portion of both tubes and introduced into the condenser stage (plates 230 and 225). Further, condensed mixture would then reflow back down the inner surfaces of both tubes (which may be mesh lined). It is appreciated that plate 220 would then have two columns mounted within it. The two columns would be mounted similarly to the single column shown in FIG. 4.

As herein discussed, this second embodiment of the present invention makes use of the boiling force of the lower boiling point coolant to provide circulation forces and energy to move the hot high boiling point liquid coolant throughout the inner chambers of the two stages of the self contained heat exchanger 200 in order to provide uniform heat distribution across the outer surfaces of the heat exchanger, such as surface 235. The surfaces 239, 225 and 220 then uniformly dissipate the heat to the surroundings.

Third Alternative Embodiment

Figure 5:
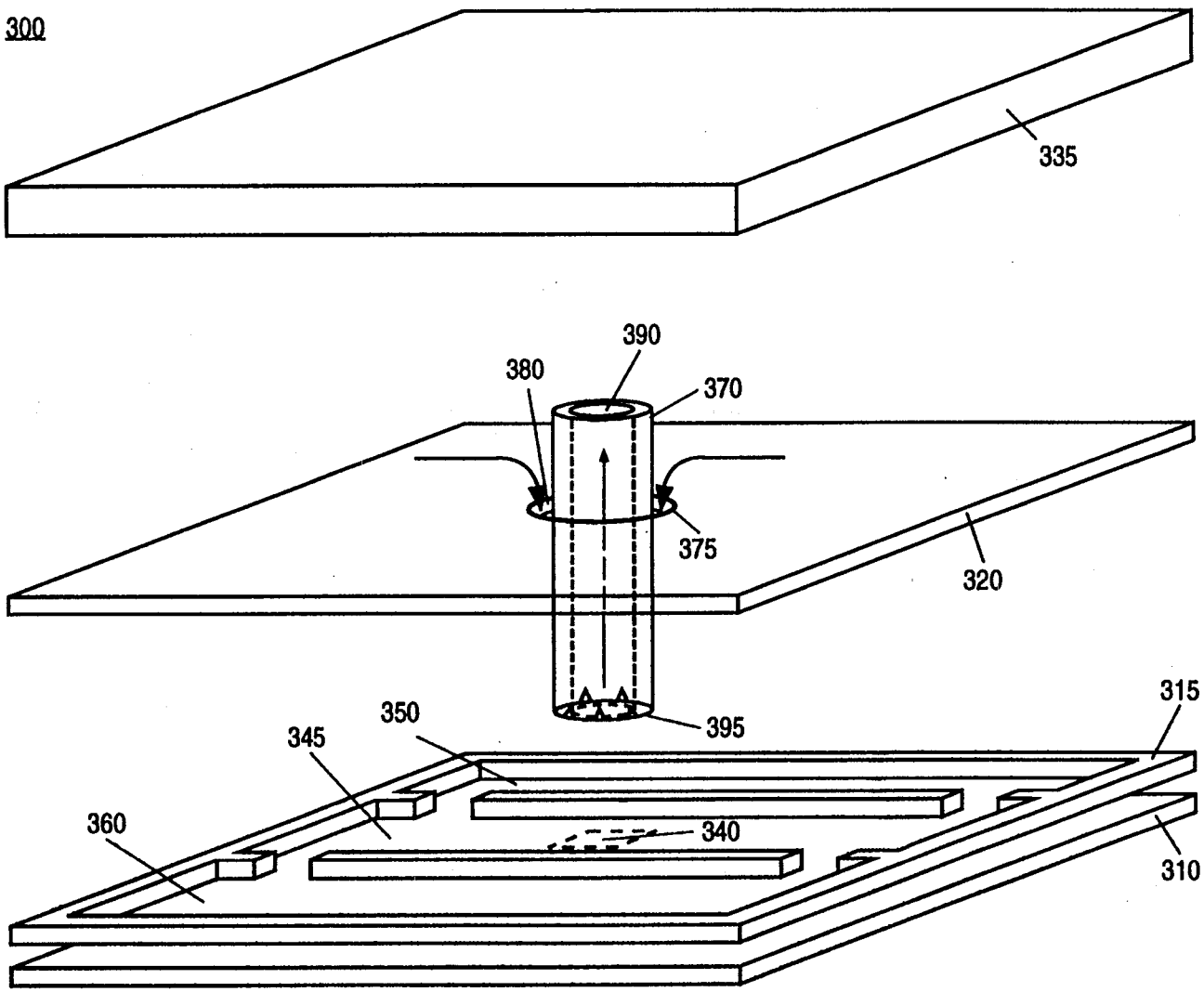
FIG. 5 is an illustration of a heat exchanger of a third alternative embodiment of the present invention utilizing an inner column or tube for transferring hot and cold coolant mixture between alternate plate radiators via the inner and outer surfaces, respectively, of the tube.

With reference to FIG. 5, a third alternative embodiment of the present invention heat exchanger is illustrated. This alternative embodiment 300 makes use of a central column, similar to the second alternative embodiment, however the central column is housed completely within the outer surfaces heat exchanger structure. Also, unlike the second alternative embodiment, this heat exchanger 300 design flows hot coolant via the inner portion of the column and channels cold coolant via the outer surface of the column whereas with the second alternative embodiment all coolant flow takes place within the column's inner portion.

Specifically, it is understood that the lower cover plate 310 and the first, stage 315 of the heat exchanger 300 of FIG. 5 operate substantially as the first stage 215 and lower plate 210 of the heat exchanger 200 of FIG. 4. The plate 310 of FIG. 5 is adhesively coupled with the solid state device and a hot spot 340 is formed within the first stage 315 of heat exchanger 300 for receiving most of the heat transferred to the exchanger from the solid state device. The first stage 315 contains a central hot chamber 345 and two peripheral condenser chambers 350 and 360 which are separated by inner walls having flow notches as shown. The lower surface of the central column 370 of FIG. 5 is mounted onto the surface of plate 315 of the first stage. Flow notches 395 are cut into the column 370 to allow coolant flow from the first stage into the central column 370 and vice-versa because in this embodiment the column 370 mounts to the bottom plate of the first stage. Condenser plate 320 surrounds the central column and contains an aperture 375 that is larger in diameter than the central column 370 forming a gap 380. The plate 320 is coupled on top of the first stage 315 to complete the lower chambers 350, 345, and 360.

The upper cover 335 is placed on top of both the plate 320 and the central column 370 to provide an overall seal for the heat exchanger but does not seal the opening 390 of the column. When assembled the central column of the heat exchanger 300 is completely contained within the exchanger's outer structure and surface, unlike the heat exchanger 200 of FIG. 4. Also when assembled, the opening 390 is allowed to eject hot coolant mixture (vapor LBP coolant and liquid HBP coolant) into the second stage onto plate 320. There is a gap 380 between the aperture of plate 320 and the central column 370 to allow condensed coolant flow from plate 320 down to the first stage 315 via the outer surface of column 370.

In operation, coolant mixture of the type used in the previous embodiments of the present invention is injected into the heat exchanger 300. The LBP coolant will come to a boil at the hot spot 340 and will be forced upward, along with hot HBP liquid coolant (i.e., water may be used) through the center of column 370 and out of the opening 390. Hot LBP coolant vapor and hot HBP liquid coolant will also be forced through notches 395 into the condenser chambers 350 and 360 which operate essentially as those of the preferred embodiment and therefore their operation and description are not repeated herein. Hot mixture vapor and hot liquid water (carried therewith) is ejected from the column opening 390 and is ejected onto plate 320 which, along with cover 335, form a condenser stage. The hot coolant releases its heat energy, which dissipates largely though surface 335 and plate 320 and will condense in the upper stage. It is understood that condensation also occurs within the two condenser chambers 350 and 360 of the first stage 315 of heat exchanger 300. Condensed coolant mixture of these chambers 350 and 360 is directed back to the hot spot 340 via capillary action of the mesh plane that is implemented within the bottom plane of the chambers of stage 315, or may be directed back via other equilibrium forces. Notches 395 allow coolant flow between the central volume of the column 370 and the first stage 315.

Referring still to FIG. 5, when condensed in total or substantially liquid form, the condensed coolant liquid will flow through opening 380 of the aperture 375 onto the outer surface of column 370 and back down to the hot spot 340 for recirculation. It is appreciated that hot coolant flows VP through the center of column 370 and condensed coolant flows down through the outer surface of column 370 according to the heat exchanger 300 of the present invention. It is also understood that a mesh surface may be placed on the outer surface of column 370 to facilitate condensation and coolant flow back to the hot spot via capillary action. Mesh planes may also be placed on the surface of the plate 315 to facilitate coolant flow between the condensation chambers and the central chamber of the first stage.

At equilibrium of the third alternative embodiment of the present invention, forces from the boiling of the lower boiling point coolant provide circulation forces and energy to move the heat rich high boiling point liquid coolant throughout the chambers of the first stage 315 and upward through the central column to the condenser stage via opening 390. This action provides efficient heat transfer from the HBP liquid coolant to surfaces of the heat exchanger and creates a uniform heat distribution across surface 335 to effectively and efficiently dissipate heat that is input to hot spot 340. Assembled heat exchangers 300 may also be layered in stages (i.e., stacked one on top of another) to provide increased heat dissipation capability, when space allows.

Fourth Alternative Embodiment

Figure 6:
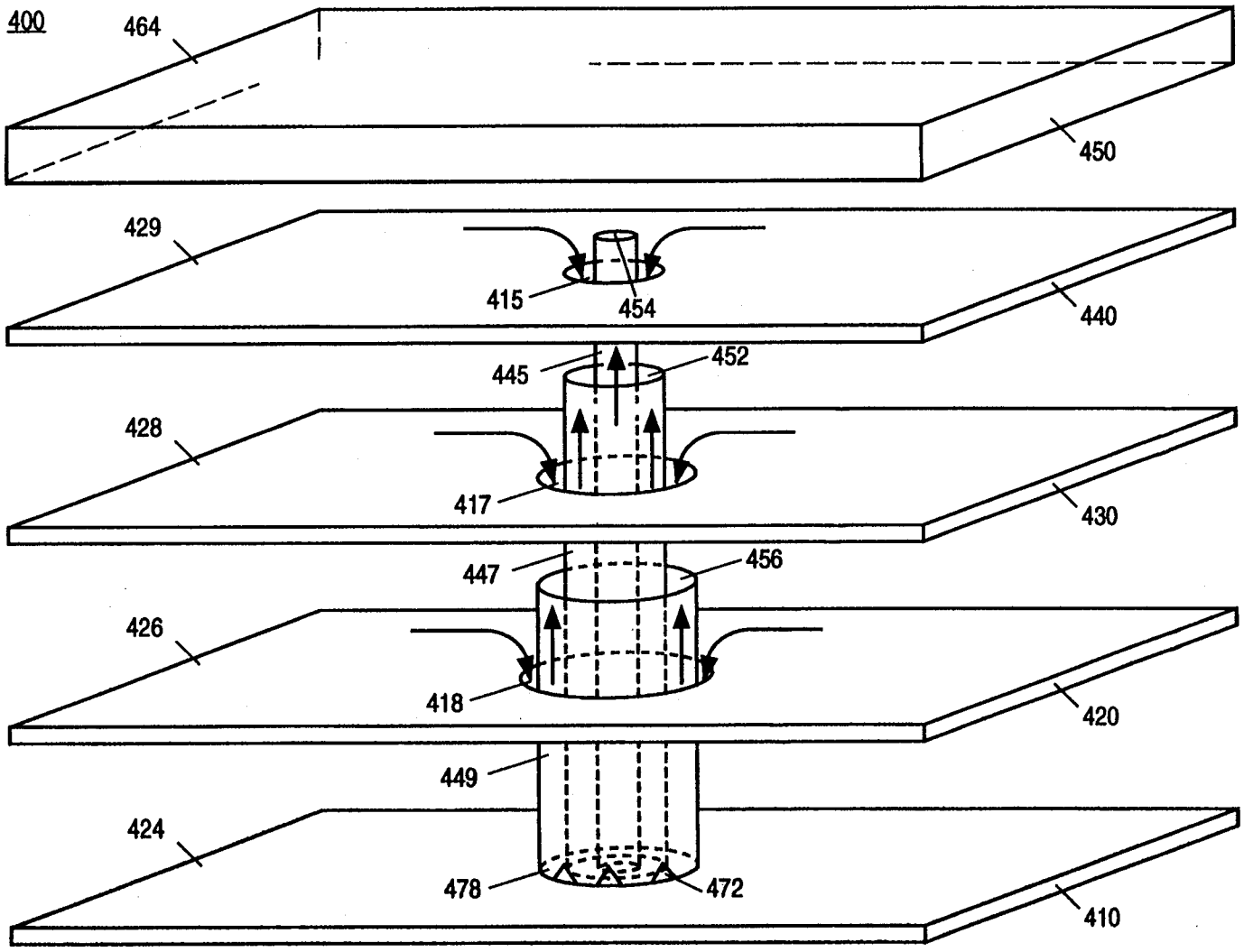
FIG. 6 is illustrates a heat exchanger of a fourth alternative embodiment of the present invention utilizing staged inner columns to transfer hot and cold coolant mixture to a number of plate radiators.

With reference to FIG. 6, a fourth embodiment of the present invention is illustrated. This heat exchanger 400 illustrated in FIG. 6 is an improvement design over the heat exchanger 300 of FIG. 5. Heat exchanger 400 provides multiple layers of condensation stages each with an associated central column for directing hot coolant mixture into the condenser stage. By providing multiple condenser and circulation stages, the present invention is able to more effectively create a uniform heat distribution to a plurality of the outer surfaces of the heat exchanger. The coolant mixture used within this heat exchanger 300 is of the same type as the other embodiments of the present invention discussed herein. The volume of coolant introduced to the embodiment of FIG. 6 is that volume required to maintain coolant flow to the hot stage 410 at equilibrium.

According to FIG. 6, the bottom plate 410 is adhesively coupled to the solid stage device and receives heat energy onto a hot spot 478 which is located beneath a central column structure 449. The central column structure is composed of several individual columns located within each other of diminishing diameters and each sharing a common central axis. The largest diameter column is structure 449, within this column is column 447 of lesser diameter and within this column is a smaller column 445 of smallest diameter. The intake openings of each column are mounted onto the first stage and are each notched, see notches 472 on column 449 for instance. These notches allow coolant flow from the first stage into the column structures. It is appreciated that first stage 410 may contain the analogous structures as first stage 210 (of FIG. 4) but these details are not shown in FIG. 6 for clarity. Second stage plate 420 contains an aperture 418 for receiving column 449; this aperture 418 is larger than the column 449 to create a pass through gap for reflow of condensed coolant mixture. Similarly, third stage plate 430 contains a larger aperture 417 than column 447 to create a pass through gap for reflow of condensed coolant mixture. Also fourth stage 440 contains a larger aperture 415 than column 445 to create a pass through gap. Upper cover plate 450 (not shown to scale), when the heat exchanger 400 is assembled, will cover all of the previous stages and provide partitioning for each individual stage.

In operation, hot spot 478 will cause hot mixture (i.e., hot LBP vapor coolant and hot HBP liquid coolant) to flow through the central portions of the three columns 449, 447 and 445 due to agitation of the boiling LBP coolant. The flow through the most central column 445 will be ejected via opening 454 onto the surface 429 of the fourth stage 440 and will condense and flow via gap 415 onto the outer surface of column 445 back to the first stage. Mesh surfaces may be used to line the outer surface of column 445. Simultaneously, the hot coolant flow through the second central column 447 will be ejected via opening 452 onto the surface 428 of the third stage 430 and will condense and flow via gap 417 onto the outer surface of column 447 back to the first stage. Mesh may be used to line the outer surface of column 447. Lastly, the hot coolant flow through the outer most central column 449 will be ejected via opening 456 onto the surface 426 of the second stage 420 and will condense and flow via gap 418 onto the outer surface of column 449 back to the first stage 410. Mesh may be used to line the outer surface of column 449. As the coolant is ejected onto and condenses within each of the three stages, plates 429, 428 and 226 along with the upper cover 464 will uniformly radiate heat as a result of the circulation of the HBP liquid coolant. The same is true for plate 410. This uniform radiation of heat throughout the inner and outer surfaces of heat exchanger 400 provides an effective and efficient heat dissipation capability for this fourth alternative embodiment of the present invention.

Due to small diameter of the inner tubes, enough pressure exists to force the hot mixture upward to the upper stages of this heat exchanger 400. Therefore, when space allows, heat exchangers of this design can be implemented with a relatively large height dimension (on the order of several inches tall, or more, is allowable) and having many intermediate condenser stages. At equilibrium, hot coolant mixture is distributed, via individual central columns, to different condenser stages. Once condensed, this coolant is directed back to the hot spot 478 via capillary action of the mesh covered outer surfaces of the columns (449, 447, 445) and via other equilibrium forces. Notches (i.e., 472) within the intake openings of the three columns allow the coolant mixture to enter the inner volumes of the central columns (i.e., flow to the uptake openings is facilitated).

At equilibrium of the fourth alternative embodiment of the present invention, forces from the boiling of the lower boiling point coolant provide circulation forces and energy to move the heat rich high boiling point liquid coolant throughout the chambers of the first stage 410 and upward through the three individual central columns to the three condenser stages via openings 456, 452, and 454. This action causes uniform HBP liquid circulation within these intermediate stages and provides a uniform heat distribution across surfaces 410, 420, 430, 440, and 450 to effectively and efficiently dissipate heat that is input to hot spot 478. Assembled heat exchangers 400 may also be layered in stages (i.e., stacked one on top of another) to provide increased heat dissipation capability, when space allows.

Fifth Alternative Embodiment

Figure 7:
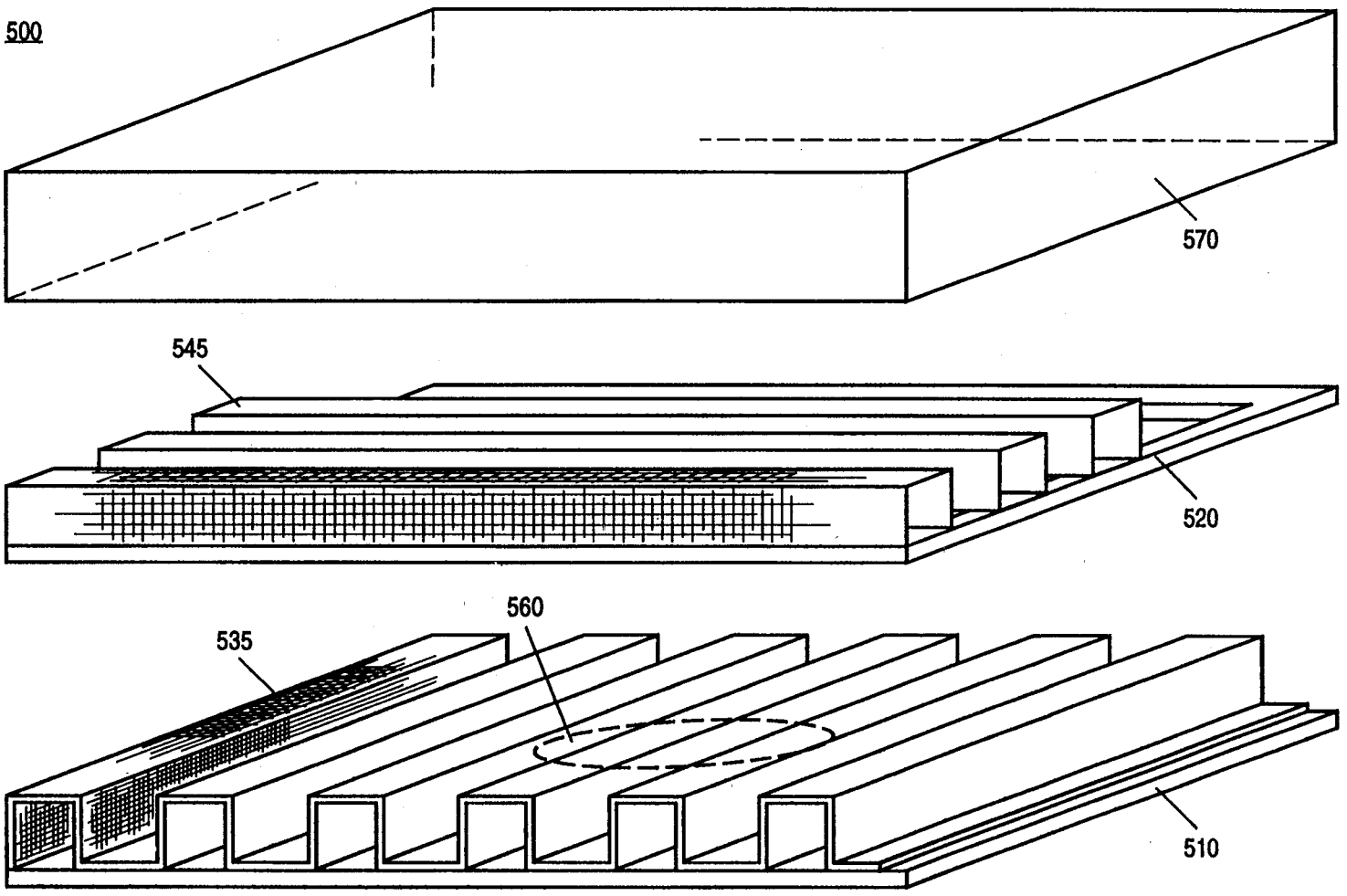
FIG. 7 is an illustration of a heat exchanger of a fifth alternative embodiment of the present invention which utilizes individual stages each composed of mesh for receiving, cooling and directing travel of the coolant mixture.

With reference to FIG. 7, a fifth alternative of the present invention is illustrated. Heat exchanger 500 contains two stages filled with a rolling mesh structure for each stage; a lower and an upper stage are illustrated. As shown in FIG. 7, the bottom stage 510 contains a hot spot 560 within plate 510 which is thermally coupled with the heat source, i.e., the solid state device. The first stage also contains a thin wire or metal mesh 535 (as discussed previously) that is rolled like a ribbon across the surface of the bottom stage 510 in a first direction or orientation. This metal mesh is a first layer of foldings in a first direction or orientation and allows coolant mixture flow in this direction. On top of the first stage is a second stage 520 that contains no bottom plate but rather is only a frame 520 which contains a second mesh structure 545 similar to mesh structure 535, however, mesh structure 545 is oriented at 90 degrees rotation from mesh structure 535 allowing coolant mixture flow in this direction. The second mesh structure is a layer of mesh foldings. A cover 570 completely seals the structures of the two stages of heat exchanger 500. Although folding layers are shown in FIG. 7, it is appreciated that a number of mesh designs may be implemented as long as they provide a suitable surface for condensing and redirecting the coolant mixture and exchanging heat from the HBP coolant to the outer surfaces of the chamber.

The mesh foldings of both layers of this embodiment of the present invention may be rounded on the edges or may be square on the folding edges, as shown in FIG. 7. The square foldings as shown in FIG. 7 are each approximately 1/16 in height by 1/16 inch in width.

In operation, a coolant mixture is introduced into the interior structures of heat exchanger 500. This coolant mixture is similar to the mixtures discussed above and therefore contains a LBP coolant and a HBP coolant mixed together. The volume of coolant introduced is that volume that does not exceed the volume of the first stage 510 of the heat exchanger 500. Coolant mixture is injected into the first stage in order to fill approximately 60% of the first stage volume. At equilibrium, the LBP coolant will agitate and under boiling forces will spread (carrying therewith heat rich HBP liquid coolant) throughout the upper and lower stages of the heat exchanger 500. The hot coolant mixture will therefore be spread throughout the mesh structures 535 and 545 of the present invention. Within the mesh foldings, the coolant mixture will condense and radiate heat onto the outer surface 570 which will be maintained at a uniform heat distribution at equilibrium. The mesh structures also provide flow or circulation direction for the condensed coolant to flow back to the first stage via capillary forces. It is appreciated that the mesh structures 535 and 545 are oriented at 90 degrees configuration in increase the number of avenues available for recirculation of the condensed coolant mixture back to the hot spot 560 of first stage 510 from the second stage 520 and outer portions of the first stage.

Due to the circulation of the HBP liquid coolant that is caused from agitation of the LBP vapor coolant, a uniform heat distribution is formed across the outer surfaces 570 of the heat exchanger 500. Capillary forces and equilibrium forces maintain circulation of the condensed coolant back to the hot spot 560 via the mesh structures of this heat exchanger.

The various embodiments of the present invention, a heat exchanger device useful to reduce the operational temperature of a solid state device by utilizing surfaces of uniform heat distribution created due to heat transfer characteristics and high surface contact of a high boiling point coolant in liquid form that is agitated and circulated due to vapors and boiling action from a low boiling point coolant, is thus described. While the present invention has been described in particular embodiments, it should be appreciated that the present invention should not be construed as limited by such embodiments, but rather construed according to the below claims.

What is claimed is:

1. A method of dissipating heat from a heat source to maintain said heat source within an operational temperature range, said method comprising the step of:

providing a coolant mixture within a hermetically sealed chamber, said coolant mixture comprising a first coolant with a boiling point below said temperature range and a second coolant with a boiling point above said temperature range;

thermally coupling said sealed chamber with said heat source;

providing a plurality of condenser chambers each coupled to said sealed chamber wherein each of said condenser chambers contains a mesh structure;

boiling said first coolant to provide energy to circulate and agitate said second coolant;

transferring heat from said second coolant to said sealed chamber, wherein said second coolant promotes heat transfer;

electing said second coolant from said sealed chamber into said plurality of condenser chambers through individual inlet holes coupling each condenser chamber to said sealed chamber;

reflowing said second coolant from said plurality of condenser chambers back to said sealed chamber using said mesh structure; and radiating heat from outer surfaces of said sealed chamber.

2. A method of dissipating heat as described in claim 1 wherein said outer surfaces are maintained at substantially uniform heat distribution and wherein said heat source is a solid state electronic component.

3. A method of heat dissipation from a heat source, said method comprising the steps of:

providing a first chamber for thermally coupling with said heat source and providing a second chamber for condensation;

providing a mesh plane within said second chamber;

boiling a first coolant in said first chamber to provide transfer energy, said first coolant having a lower boiling point than an operational temperature range of said heat source;

using said transfer energy, transferring a second coolant from said first chamber to said second chamber through an inlet valve, said second coolant having a higher boiling point than said operational temperature range of said heat source, wherein said second coolant promotes heat transfer and wherein said second coolant has higher molecular density over said first coolant;

reflowing said second coolant from said second chamber back to said first chamber using said mesh plane; and uniformly radiating heat from said second chamber.

4. A method of heat dissipation from a heat source as described in claim 3 wherein said step of transferring a second coolant comprises the step of carrying said second coolant into said second chamber by boiling action and agitation of said first coolant.

5. A method of heat dissipation from a heat source as described in claim 3 wherein said heat source is a semiconductor device.

6. A method of heat dissipation from a heat source as described in claim 3 wherein said second coolant is water.

7. A method of heat dissipation from a heat source as described in claim 3 wherein said step of uniformly radiating heat from said second chamber comprises the step of transferring heat content of said second coolant, in liquid state, to inner surfaces of said second chamber.

8. A heat exchanging method of regulating the temperature of a solid state device within an operational temperature range, said method comprising the steps of:

providing a first chamber for thermally coupling with said solid state device and providing a second chamber for condensation;

providing said first chamber and said second chamber with a connecting mesh plane;

providing a coolant mixture of a first coolant having a lower boiling point than said operational temperature range and a second coolant having a higher boiling point than said operational temperature range;

boiling said first coolant in said first chamber to agitate said second coolant;

transferring said first coolant and said second coolant into said second chamber through a single inlet valve as a result of agitation of said step of boiling, wherein said second coolant transfers heat out of said coolant mixture to promote heat dissipation; and reflowing said second coolant from said second chambers back to said first chamber using said mesh plane.

9. A heat exchanging method as described in claim 8 further comprising the steps of:

transferring heat content of said second coolant to surrounding surfaces of said second chamber to provide a substantially uniform heat distribution across outer surfaces of said second chamber; and radiating heat from said outer surfaces of said second chamber.

10. A heat exchanging method as described in claim 8 further comprising the step of reflowing said coolant mixture from said second chamber to said first chamber forces of said mesh plane.

11. A heat exchanging method as described in claim 8 wherein said solid state device is a microprocessor.

12. A heat exchanging method as described in claim 8 further comprising the step of evacuating any air from said first chamber and from said second chamber before said step of providing said coolant mixture.

13. A self contained heat exchanging apparatus for regulating the temperature of a heat producing device within an operational temperature range, said apparatus comprising:

coolant mixture means for transferring heat content to inner surfaces of said heat exchanging apparatus, said coolant mixture means comprising a first coolant with a boiling point below said operational temperature range and a second coolant with a boiling point above said operational temperature range, wherein said first coolant boils to agitate said second coolant and wherein said second coolant is for transferring heat to said inner surfaces of said heat exchanging apparatus to dissipate said heat and wherein said second coolant is of higher molecular density over said first coolant;

structure means for thermally coupling with said heat producing device and for allowing said first coolant to boil and agitate said second coolant, wherein said coolant mixture is sealed within said inner surfaces of said heat exchanging apparatus; and condenser means for receiving transferred coolant mixture means ejected from said structure means, said condenser means for uniformly radiating heat transferred thereto by said second coolant, said condenser means coupled to said structure means.

14. A heat exchanging apparatus as described in claim 13 further comprising means for reflowing said coolant mixture means from said condenser means to said structure means.

15. A heat exchanging apparatus as described in claim 14 wherein said condenser means further comprises plate radiator means for radiating heat said plate radiator means having a substantially uniform heat distribution.

16. A heat exchanging apparatus as described in claim 14 wherein said means for reflowing comprises a mesh means for directing coolant mixture by capillary forces.

17. A heat exchanging apparatus as described in claim 15 wherein said second coolant is water and further comprising means for evacuating air from said structure means and from said condenser means.

18. A heat exchanging apparatus as described in claim 15 wherein said second coolant is water.

19. A heat exchanging apparatus as described in claim 15 wherein said heat producing device is a semiconductor device.

20. A heat exchanging apparatus as described in claim 15 wherein said condenser means comprises a plurality of individual condenser chambers coupled to said structure means.

21. A heat exchanging apparatus as described in claim 15 wherein said substantially uniform heat distribution of said plate radiator means results substantially from heat transfer of said second coolant in liquid state.

22. A self contained closed loop heat exchanger for regulating the temperature of a heat producing device within an operational range, said heat exchanger comprising:

a coolant mixture comprising a first coolant with a boiling point below said operational range and a second coolant with a boiling point above said operational range;

a first chamber for thermally coupling with said heat producing device and for providing a boiling location for said first coolant;

a plurality of condenser chambers each individually coupled with said first chamber via an inlet hole, said condenser chambers for receiving ejected hot first and second coolant from said first chamber, wherein said coolant mixture is sealed within an area containing both said plurality of condenser chambers and said first chamber;

outer heat radiation surfaces maintained at substantially uniform heat distribution, said outer heat radiation surfaces coupled to said first chamber and coupled to said plurality of condenser chambers, wherein said first coolant boils to agitate said second coolant and wherein said second coolant is for transferring heat to said outer heat radiation surfaces to promote dissipation of said heat: and a mesh plane for promoting condensation and for reflowing said coolant mixture from said plurality of condenser chambers to said first chamber, said mesh plane coupled with said first chamber and coupled with said plurality of condenser chambers.

* * * * *